US007930771B2

(12) United States Patent
Depreitere et al.

(10) Patent No.: US 7,930,771 B2
(45) Date of Patent: Apr. 26, 2011

(54) PROTECTIVE HELMET

(75) Inventors: Bart Depreitere, Herent (BE); Jan Goffin, Herent (BE); Carl Van Lierde, Leuven (BE); Bart Haex, Heverlee (BE); Jos Vander Sloten, Boortmeerbeek (BE); Remy Van Audekercke, Mechelen (BE); George Van der Perre, Huldenberg (BE); Ignace Verpoest, Kessel-Lo (BE); Peter Verschueren, Bierbeek (BE); Hans Delye, Wilsele (BE)

(73) Assignee: K.U. Leuven Research & Development, Leuven (BE)

( * ) Notice: Subject to any disclaimer, the term of this patent is extended or adjusted under 35 U.S.C. 154(b) by 532 days.

(21) Appl. No.: 11/632,425

(22) PCT Filed: Jul. 13, 2005

(86) PCT No.: PCT/BE2005/000115

§ 371 (c)(1),
(2), (4) Date: Jan. 12, 2007

(87) PCT Pub. No.: WO2006/005143

PCT Pub. Date: Jan. 19, 2006

(65) Prior Publication Data

US 2008/0066217 A1 Mar. 20, 2008

(30) Foreign Application Priority Data

Jul. 13, 2004 (GB) ..... 0415629.5

(51) Int. Cl.
*A42B 3/00* (2006.01)

(52) U.S. Cl. ..... 2/411; 2/410

(58) Field of Classification Search ..... 2/410, 411, 2/414, 455

See application file for complete search history.

(56) References Cited

U.S. PATENT DOCUMENTS

| | | | | |
|---|---|---|---|---|
| 3,174,155 | A * | 3/1965 | Pitman | 2/411 |
| 3,447,163 | A | 6/1969 | Bothwell et al. | |
| 5,561,866 | A | 10/1996 | Ross | |
| 5,637,389 | A * | 6/1997 | Colvin et al. | 428/308.4 |
| 6,183,836 | B1 | 2/2001 | Pflug | |
| 6,658,671 | B1 | 12/2003 | Von Holst et al. | |
| 6,726,974 | B1 | 4/2004 | Pflug et al. | |
| 2002/0023291 | A1 | 2/2002 | Mendoza | |
| 2004/0117896 | A1 | 6/2004 | Madey et al. | |
| 2006/0148919 | A1 * | 7/2006 | Maurer et al. | 521/137 |

FOREIGN PATENT DOCUMENTS

| | | | |
|---|---|---|---|
| DE | 44 08 928 | A1 | 3/1994 |
| EP | 1 142 495 | A1 | 10/2001 |
| FR | 2 561 877 | | 10/1985 |
| WO | WO 01/45526 | A1 | 6/2001 |
| WO | WO 2004/032659 | A1 | 4/2004 |

* cited by examiner

*Primary Examiner* — Shaun R Hurley
*Assistant Examiner* — Andrew W Sutton
(74) *Attorney, Agent, or Firm* — Bacon & Thomas, PLLC

(57) ABSTRACT

A protective helmet is described comprising: an outer layer (1); an inner layer (5) for contact with a head of a wearer; and an intermediate layer (3, 4) comprising an anisotropic cellular material comprising cells having cell walls, the anisotropic cellular material having a relatively low resistance against deformation resulting from tangential forces on the helmet. The anisotropic material can be a foam or honeycomb material. The foam is preferably a closed cell foam. The helmet allows tangential impacts to the helmet which cause less rotational acceleration or deceleration of the head of the wearer compared to helmets using isotropic foams while still absorbing a significant amount of rotational energy.

20 Claims, 6 Drawing Sheets

| | Stress at 0,6 strain | |
|---|---|---|
| Angle | PS | PES |
| 0 | 0,73 | 0,43 |
| 15 | 0,65 | 0,29 |
| 45 | 0,43 | 0,24 |
| 75 | 0,26 | 0,03 |

PROTECTIVE HELMET

FIELD OF THE INVENTION

The present invention relates to a protective helmet, such as a helmet which can be worn by a cyclist, motorcyclist, pilot, bobsleigh sportsperson, etc. to protect against injury as well as a method of manufacture thereof.

BACKGROUND OF THE INVENTION

Epidemiological studies on accidents (e.g. bicycle accidents) show that a substantial number of the subjects who call for medical aid, are suffering from skull and brain damage. Furthermore, cranio-cerebral traumas are a direct cause for the majority of the fatal accidents. A protection helmet should therefore protect the head against these traumas.

There are many types of protective helmets on the market, with different designs and characteristics. They are designed to satisfy legal requirements, but do generally not offer a protection to the most common skull and brain damages. At present, these legal requirements are related to the maximum linear acceleration that may occur in the centre of gravity of the brain at a specified load, and may involve tests in which a so-called "dummy skull", equipped with a helmet, is subjected to impact. As a result of these legal requirements, helmets that are currently available on the market offer a good protection in the case of a normal impact on the head. Fractures of the skull and/or pressure or abrasion injuries of the brain tissue typically occur after this type of impact. These helmets generally consist of three functional units, which are conceived in three separate layers that are always ordered as follows: a hard outer shell that distributes forces acting on the head over a larger surface, an energy-absorbing middle shell, and an inner layer that guarantees a comfortable fit on the head.

However, mathematical simulations (see FIG. 1) show that rotational accelerations of the head increase with an increasing tangential component $F_t$ of the impact force F (see FIG. 3), while helmets that are currently available on the market do not offer a sufficient protection against impact that is tangential to the head. Furthermore, literature (both early and recent [1]-[7]) shows that the most common brain injuries are related to rotational accelerations (not linear accelerations) while legal requirements and standards do not include this aspect. Typical injuries related to head rotation are contusions, ASDH (Acute Sub-Dural Haematoma; bleeding as a consequence of blood vessels rupturing), and DAI (Diffuse Axonal Injuries; widespread damage to axons in the white matter of the brain). Although the understanding of the precise mechanical processes that lead to these specific injuries is still imperfect, recent research [7] has revealed, inter alia, a relation between brain parenchyma and bridging vein lesions on the one hand and the rotational acceleration of the head on the other hand. The type and the severity of the injury depend on the development of impact parameters as a function of time, such as the duration and the amplitude.

US 2002/0023291 A1 describes a helmet designed to protect the head and brain from both linear and rotational impact energy, constructed of 4 layers, the layers comprising polyurethane, monoprene gel, polyethylene and either polycarbonate or polypropoylene. U.S. Pat. No. 6,658,671 describes a protective helmet with an inner and an outer shell with in between a sliding layer and whereby the inner and the outer shell are interconnected with connecting members. EP1142495 A1 describes a helmet in which a layer of elastic body (which may be a gel) is provided between the inner side of the shell and the shock absorbing liner, or in between two layers of the shock absorbing liner. WO2004/032659A1 describes a head protective device with an inner and an outer layer, and an interface layer with a spherical curvature, allowing displacement of the outer layer with respect to the inner layer. The interface layer may consist of a viscous medium, a hyper-elastic structure, an elastomer-based lamellar structure, or connecting members. These helmets, however, only allow a limited rotational displacement of the inner shell with respect to the outer shell, because the shape of the helmet is not a perfect hemisphere. Consequently, the energy that can be dissipated is limited as well. Furthermore, these helmets have poor ventilation capacities, and are relatively complex to manufacture.

SUMMARY OF THE INVENTION

The present invention seeks to provide a helmet which offers better protection against head (brain, skull, etc) injury and damage as a consequence of linear as well as rotational acceleration upon an accident.

A first aspect of the present invention provides a protective helmet comprising:

- an outer layer;
- an inner layer for contact with a head of a wearer; and
- an intermediate layer comprising an anisotropic cellular material with cells having cell walls, the anisotropic cellular material having a relatively low resistance against deformation resulting from tangential forces on the helmet.

A cellular material is one made up of an interconnected network of struts and/or plates which form edges and faces or walls of cells. Cellular materials with cells having cell walls can provide the advantage that crushing or compaction of the walls can absorb more impact energy than materials with only pillars or struts. The use of a layer which is formed of an anisotropic material has the benefit of allowing rotational energy, i.e. energy which is applied to the helmet by tangentially-directed forces with respect to the surface of the helmet and hence with respect to the head of the wearer, to be absorbed by the helmet in such a way that the rotational acceleration or deceleration of the head is kept low. The energy absorption is achieved without the need for layers to slide with respect to one another, and thus the helmet does not need to be perfectly spherical. This provides a protective helmet that reduces the risk of injury for the wearer, by protecting against different types of injury. The anisotropic material can be a macroscopic or microscopic cellular material, such as a foam, preferably closed-cell, or a honeycomb structure. A closed cell structure can have some open cells, e.g. when some cell walls rupture. However, the closed cell structure does have mainly cells with cell walls whereas an open cell structure comprises mainly struts and no cell walls.

It has been found that some anisotropic materials can provide good energy absorption in both tangential and normal directions with respect to the helmet and thus it is possible to provide a layer with both properties in a compact structure. One example of such a material is polyethersulfone (PES) although other plastic materials, e.g. thermoplastic, thermosetting or elastomeric materials may be used, e.g. polyurethane or other materials, e.g. foamed metals or carbon.

The helmet preferably combines five functional units to protect the head against both linear and rotational accelerations which protect the head against both skull and brain damage. The first functional unit of the helmet is a hard layer that distributes forces acting on the head over a larger surface; the second unit is a relatively soft layer that is able to absorb a part of the impact energy without transferring potentially harmful forces to the head; the third functional unit protects the head against normal forces ($F_n$ on FIG. 1); the fourth unit protects the head against tangential forces ($F_t$ on FIG. 1). The fifth functional unit ensures a comfortable fit of the helmet on the head. There are various ways in which these functional units are embodied as physical layers, and a single functional unit does not necessarily correspond to a single physical layer (i.e. several functional units can be combined into one physical layer and one functional unit can be designed into several physical layers). The layers can be kept together, for example, by glue. All combinations/sequences of physical layers are possible. In one preferred embodiment the third (3) and fourth (4) functional units are combined into one layer of anisotropic material.

Two functional units can be designed into two physical layers where each of the layers takes part in both functions; for example, two layers with different "easy" directions of the anisotropy, i.e. directions in which there is a low resistance to deformation compared to other directions, protect against linear and/or rotational accelerations generated by forces in two different directions.

In another aspect of the invention, also an extra protection for other parts of the head may be provided, e.g. chin protection or protection for the temples or eyes, and combined in the protective helmet of the present invention.

BRIEF DESCRIPTION OF THE FIGURES

Embodiments of the present invention will be described, by way of example, with reference to the accompanying drawings in which:

FIG. 10 compares material behaviour under influence of a tangential force (stress as a function of strain) of an isotropic structure (material A) with an anisotropic structure (material B), N.B. Under normal forces the behaviour of the two materials would be similar;

DETAILED DESCRIPTION OF THE INVENTION

Figure 1:
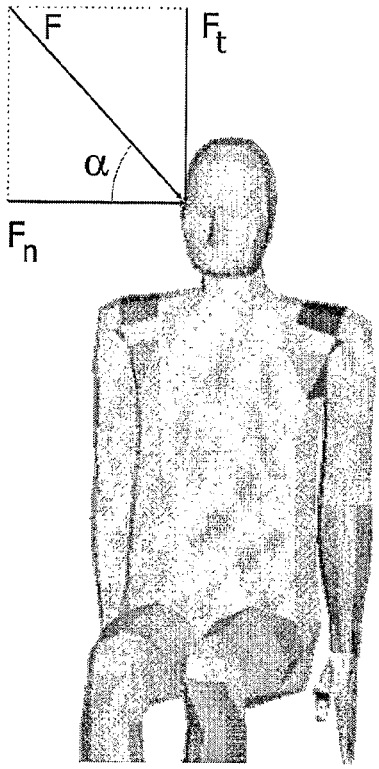
FIG. 1 shows a graphic representation of an external force F acting on the head at an angle α. This force F can be subdivided into a tangential component $F_t$ and a normal component $F_n$.
Figure 2:
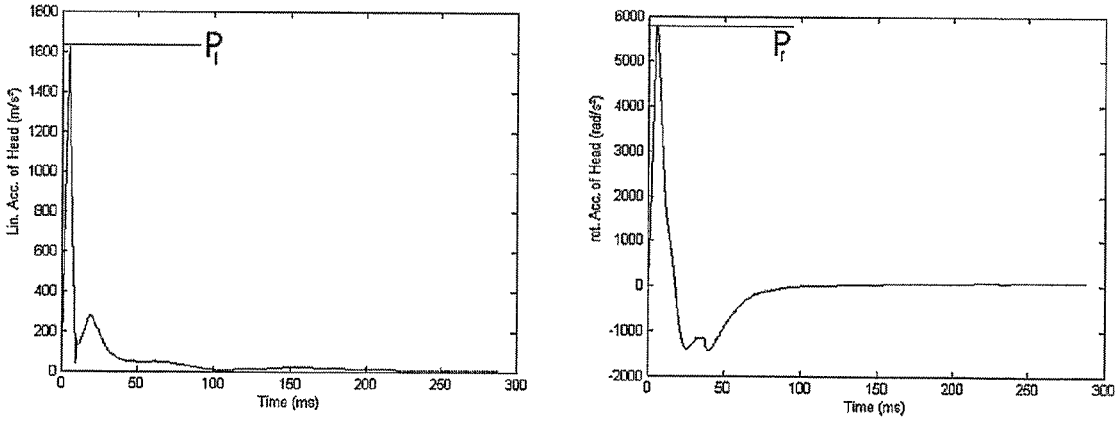
FIG. 2 shows the linear acceleration of the head (left) and the rotational acceleration of the head (right) as a function of time after impact by an external force F under an angle α=0°, and the corresponding linear and rotational peak accelerations $P_l$ and $P_r$.
Figure 3:
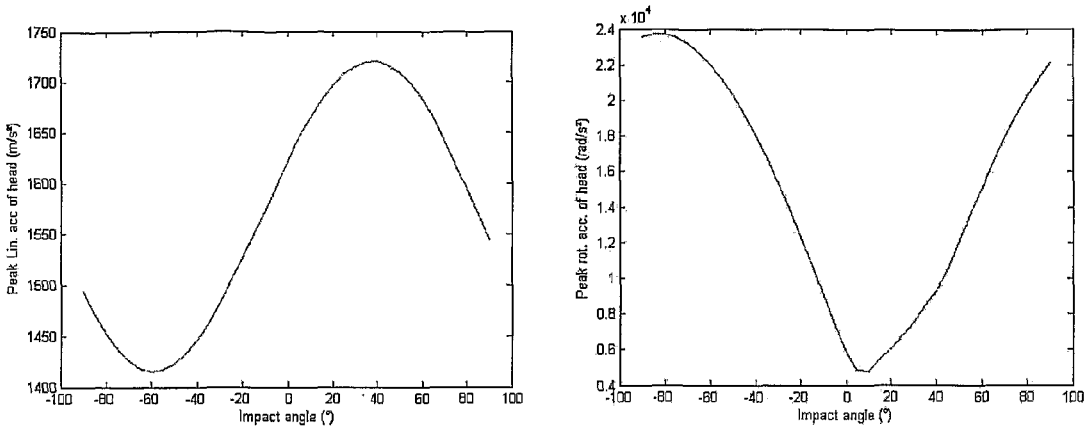
FIG. 3 gives the linear (left) and rotational (right) peak acceleration of the head after impact by an external force F as a function of the impact angle α, as defined on FIG. 1.

The present invention will be described with respect to particular embodiments and with reference to certain drawings but the invention is not limited thereto but only by the claims. Any reference signs in the claims shall not be construed as limiting the scope. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

An embodiment of the protective helmet will be described which combines up to five functional units to protect the head against both linear and rotational accelerations. When compared to standard helmets, which only consist of a hard outer shell (1), an energy-absorbing middle shell (3), and an inner fitting layer (5), this helmet offers a more complete protection by absorbing a part of the impact energy in a dedicated functional unit (2) without transferring potentially harmful forces to the head (and inner physical layers, if present), and by a protection against tangential impact forces in a dedicated functional unit (4). All functional units are able to act simultaneously.

Furthermore, the three functional units of a standard helmet are always materialized into the same three physical layers, which are always ordered the same way, while in case of a protective helmet according to the invention, the five functional units are materialized into a number physical layers, wherein one single functional unit does not necessarily correspond to one single physical layer (i.e. several functional units can be combined into one physical layer and one functional unit can be designed into several physical layers).

Figure 4:
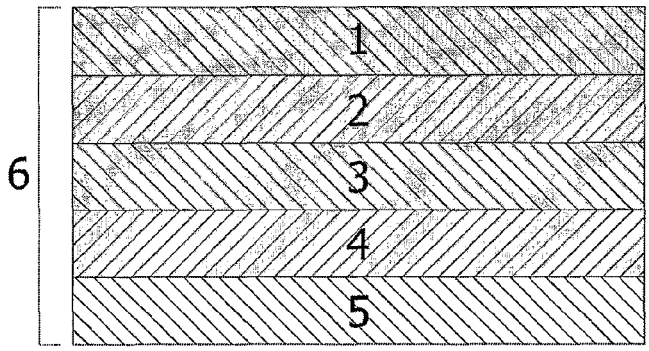
FIG. 4 shows a cross-section of functional units of a protective helmet according to the invention.

A protective helmet (6)—according to the invention shown in FIG. 4—comprises up to five functional units. A unit is not necessarily a layer. The first functional unit (1) is a hard layer that distributes forces acting on the head over a larger surface; the second unit (2) is a relatively soft layer that is able to absorb a part of the impact energy without transferring potentially harmful forces to the head; the third functional unit (3) protects the head against normal forces ($F_n$); the fourth unit (4) protects the head against tangential forces ($F_t$). The fifth functional unit (5) ensures a comfortable fit of the helmet on the head.

Figure 5:
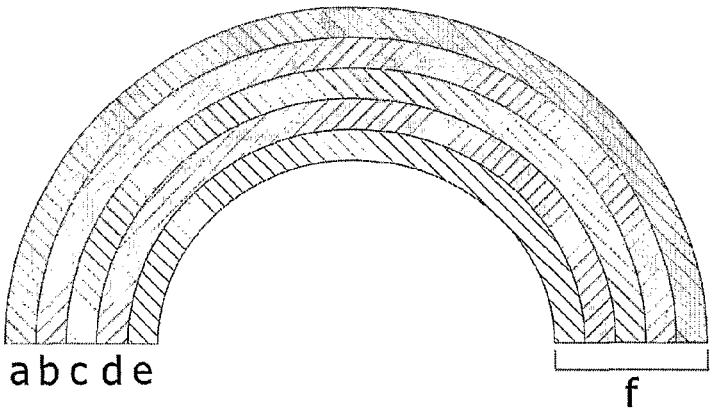
FIG. 5 shows a cross-section of a possible arrangement of physical layers of a protective helmet according to the functional units of FIG. 4.

An embodiment of a protective helmet, according to FIG. 5, may comprise an arrangement of five different physical layers, where each layer corresponds to one functional unit. The first layer (a) is a hard outer shell that distributes forces over a larger surface; the second layer (b) consists of a soft material that is able to absorb a part of the impact energy without transferring potentially harmful forces to the head and to the inner layers; the third layer (c) protects the head against normal forces; the fourth layer (d) protects the head against tangential forces. The fifth physical layer (e), which is intended for contact with the head of the wearer, ensures a comfortable fit.

The first functional unit (1) distributes forces acting on the head over a larger surface, and protects against the penetration of objects. In the case of the exemplary protective helmet described above—where this functional unit (1) corresponds to one outer physical layer (a)—this layer is relatively thin and can be made out of polycarbonate or fibre-reinforced plastics or a metal such as aluminum, for example. The outer physical layer of the helmet can be relatively thin, such as between 0 mm and 2 mm.

The second functional unit (2) is able to absorb a part of the impact energy without transferring potentially harmful forces to the head. In case of the exemplary protective helmet described above, the physical layer (b) corresponding to the functional unit (2) is relatively thicker and softer when compared to the outer layer (a). The physical layer can be made out of, for example, polyurethane foam or polystyrene, and the construction can vary in different ways, which are explained further.

Figure 6:
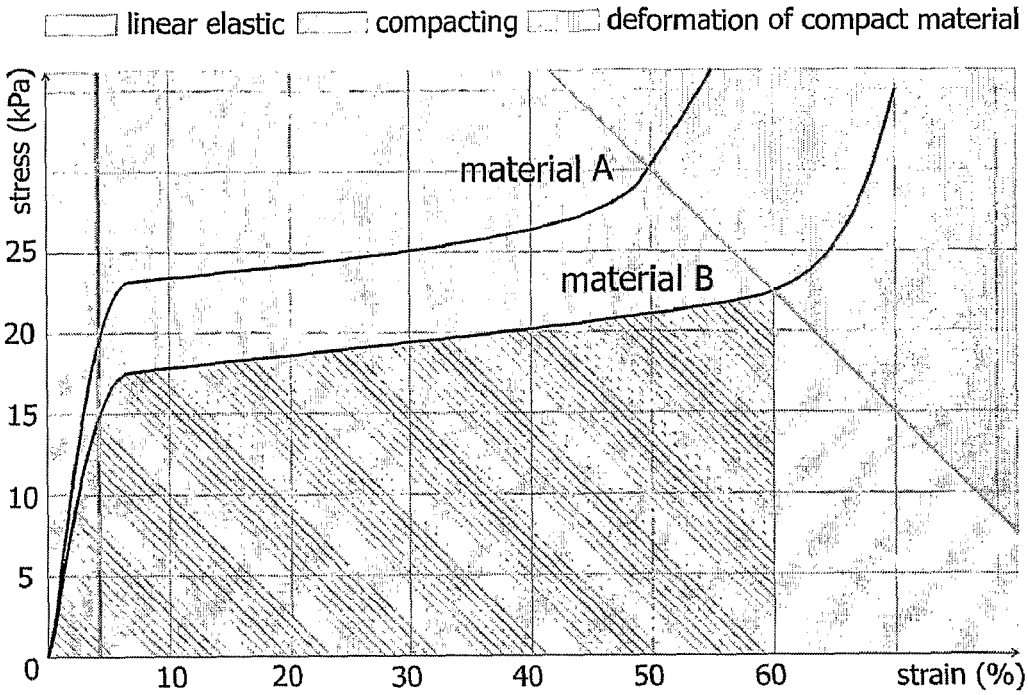
FIG. 6 shows the stress-strain behaviour of two different foam materials (A and B) under compression load; the hatched area represents the energy that is absorbed during both elastic deformation and compaction or crushing, i.e. plastic deformation.

Traditionally, the core material (i.e. the energy-absorbing middle shell) of a protection helmet consists of foam, which behaves under compression load as shown on FIG. 6: initially the elastic deformation of the material is linear, then there is a non-linear plateau where the material is compacted, and finally deformation of the compact material occurs [8]. Standardized compression tests can be used to characterize these foam parameters. When comparing different foams (e.g. polystyrene foams A and B where A has a higher density when compared to B, see FIG. 6), the elastic and plastic areas are different. The energy that is absorbed can be calculated as the integral of the stress-strain curve, and is represented (for elastic compression of material B) by the hatched area on FIG. 6. For materials that are traditionally used as liner material, the plateau lies close to the stress at which damage to the skull and brain are occurring [7].

Figure 7:
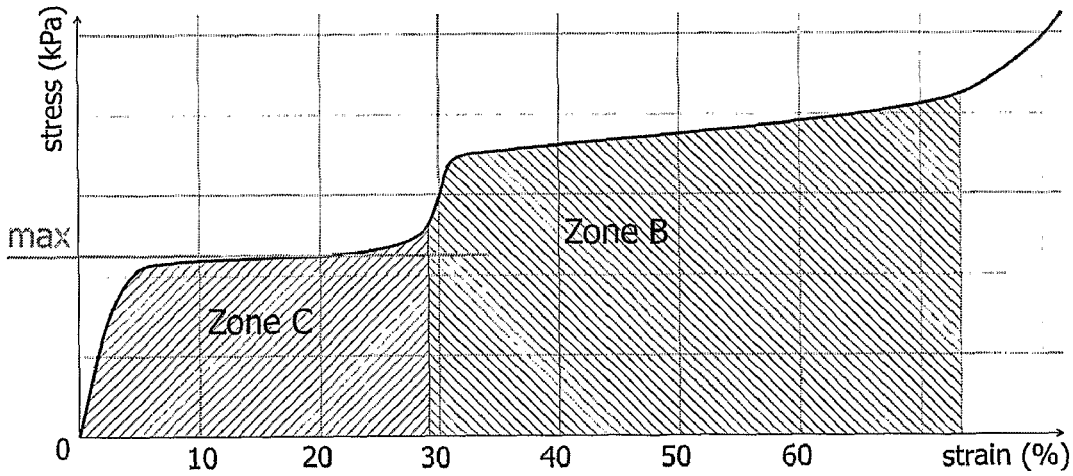
FIG. 7 shows the combined stress-strain behaviour of two different materials (B and C) under compression load; the hatched area represents the energy that is absorbed during both elastic deformation and compaction or crushing, i.e. plastic deformation. In zone C, mainly material C is working, while in zone B, mainly material B is working.

In order to decrease this effect, a functional unit (2) is conceived to absorb a part of the impact energy without transferring potentially harmful forces to the head (i.e. forces lower than a maximum value of 50 kN). In case of the materialization of the protective helmet described above, the physical layer (b) corresponding to functional unit (2) is relatively soft (see material C on FIG. 7) when compared to materials that are traditionally used as liner material (such as material B described above, see FIG. 7).

As a result, the force transferred by the material C while effective (i.e. while it is able to absorb energy, see material C on FIG. 7) is lower than the maximal force described above. The energy which can be absorbed is the integral of the force times the distance moved—the lower the force, the more distance must be used to absorb a certain amount of energy. Hence the present invention can use softer and thicker materials than used in known devices.

Thanks to the relatively low resistance of material C against compression, the transferred normal accelerations are low. Furthermore, thanks to the resulting low friction, the transferred tangential accelerations are also low. Material C is effective until energy is maximally absorbed (material C of FIG. 7) and other layers start to deform (material B of FIG. 7), as illustrated on FIG. 7.

The construction of the functional unit (2) may vary in different ways, e.g. air, foam, honeycomb patterns, and the unit may be combined with other units into one physical layer. Furthermore the physical layer or part of a physical layer corresponding to the functional unit (2) may absorb energy by elastic and/or plastic deformation.

The second functional unit (2) is preferably materialized into a physical layer that is thicker than the outer layer, such as between 2 mm and 50 mm, and is made of a softer material than the outer layer, such as polyurethane or polystyrene.

The third functional unit (3) is able to protect the head against normal forces, inter alia, by limiting the deformation of the skull. The third functional unit is able to absorb energy arising from linear impact to protect the head from skull damage. This function is comparable to the helmets that are currently available on the market. In case of the exemplary protective helmet described above—where each functional unit corresponds to one physical layer—this layer may be made out of polyurethane foam or polystyrene, for example. The third functional unit (3) can be materialized into a physical layer (c) that is made from polyurethane or polystyrene, which is softer than the outer layer (a), but firmer than the second physical layer (b).

The physical layer or part of a physical layer corresponding to the functional unit (3) may absorb energy by elastic and/or plastic deformation.

The fourth functional unit (4) is able to protect the head against forces which would induce rotational damage to the brain, i.e. it reduces rotational deceleration or acceleration forces on the head and/or absorbs energy arising from an impact on the helmet having a rotational effect on the head. In embodiments where each functional unit corresponds to one physical layer, for example, this layer has a relatively low resistance against deformation caused by a force in a tangential direction. This can be realised by using anisotropic materials and/or material structures. Anisotropy is defined as a variation of one or more material and/or structural properties with direction. Since most materials are anisotropic to some extent (e.g. due to imperfections) a material and/or structure is defined as anisotropic when the variation of a property of the material and/or structure with direction exceeds a threshold value, which depends on the material characterization test used. In case a standardized compression test is used, i.e. a standardised procedure such as disclosed in a national or international standard, a material/structure sample is subjected to compression in three orthogonal directions, and the plateau-stress (which is the mean level of the stress in the compacting zone, see FIG. 6) is calculated for each direction. Examples of such tests are ASTM-C-365: Standard test Method for flatwise compressive properties of sandwich cores and ASTM D-1621: Standard test method for compressive properties of rigid cellular plastics.

A material or structure is defined as anisotropic when the difference in plateau-stress between two orthogonal directions exceeds 15%. In accordance with embodiments of the present invention a higher level of anisotropy is preferred. The reason is that the direction of "easy" deformation (directions in which the material has a low resistance to deformation compared to other directions) is arranged to be along a direction of tangential impact so that the maximum acceleration or deceleration of the head is reduced.

Other suitable dedicated tests are described in "A material model for transversely anisotropic crushable foams in LS-Dyna", A. Z. Hirth, P. Du Bois, and K. Weimar—see http://www.dynamore.de/download/papers/strandfoam_paper_2002.pdf and "Rapid hydrostatic compression of low density polymeric foams", Y. Masso Moreu, N. J. Mills, Polymer Testing vol. 23, 2004, pages 313-322. A dedicated representative test (see FIG. 11, somewhat similar to the test described in Hirth et al.) has been used to test this property. A preferred material and/or structure in accordance with the present invention is defined as a degree of anisotropy characterised by the ratio of the plateau-stress at 0° testing to the plateau-stress at 75° testing exceeding the value 5. This degree of anisotropy provides a material which can withstand radial forces to the head while allowing movement of the helmet rotationally relative to the head at low forces, thus providing a low acceleration to the head while still absorbing the energy of the blow. As an example (see FIG. 12), isotropic polystyrene (PS) has a ratio of 2.8 (0.73/0.26) while anisotropic polyethersulfone (PES) has a ratio of 14.3 (0.43/0.03).

Figure 8:
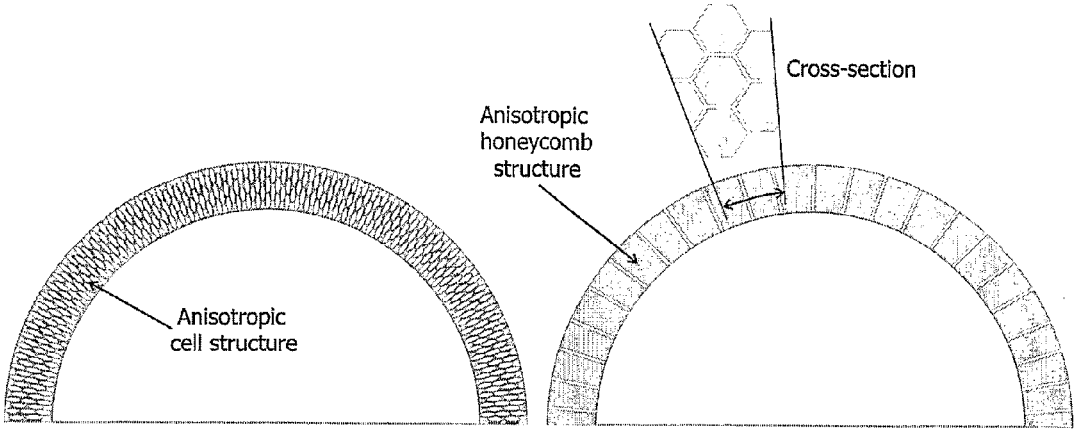
FIG. 8 shows a cross-section of a physical layer that consists of an anisotropic cell structure (left) and a physical layer that consists of an anisotropic honeycomb structure (right)

One material suitable for an anisotropic material of the present invention is an anisotropic cellular material such as a foam (see FIG. 8 left), where the material properties in different directions are different and depend, inter alia, on the cell orientation and cell wall thickness in different directions or the anisotropic cellular structures can be a honeycomb structure (see FIG. 8 right). A cellular material is one made up of an interconnected network of struts and/or plates which form edges and faces or walls of cells. A closed cell foam generally has cell walls enclosing and closing each cell to thereby trap a fluid such as a gas or a liquid but even a closed cell foam may have some open cells, e.g. where a cell wall ruptures. An open cell structure has mainly struts forming the cells with few or no cell walls. A closed cell structure is particularly preferred in accordance with the present invention as such materials can be made anisotropic so that they collapse readily in one direction, preferably a direction which is tangential to the helmet while still absorbing approximately the same amount of rotational energy as an isotropic foam.

The anisotropic properties may be determined by the fabrication methodology of the foam. Suitable methods are described, for example, in "Polyurethane Handbook", ed. G. Oertle, Hanser Verlag, 1994, in particular "Relationships between production methods and properties", page 277ff; or "Engineering Materials Handbook", vol. 2, Engineered Plastics, ASM Int. 1988, pages 256-264: Polyurethanes (H. F. Hespe) and pages 508-513: Properties of thermoplastic structural foams, (G. W. Brewer). Examples are (i) by blowing a fluid such as steam in specific directions into a mould during foaming which results in an anisotropic foam structure, (ii) pulling and extending the foam in one direction during foaming to elongate the cells, (iii) allowing slow foaming so that the natural tendency of gas bubbles formed during this process to move upwards against gravity is used to elongate the cells, (iv) enhancing the effect of gravity by applying a pressure differential; e.g. vacuum, to draw the forming gas bubbles in one direction etc.

Honeycomb structures can be fabricated with any desired ratio between cell height and width to thereby influence the anisotropic properties. A honeycomb structure can be made in sheet formed and then formed into the shape of a helmet or onto the helmet, e.g. by applying heat. The honeycomb structure can be mechanically fixed to other layers of the helmet by any suitable means, e.g. adhesive or glue, staples, heat sealing. Some representative honeycomb materials are disclosed in U.S. Pat. No. 6,726,974 and U.S. Pat. No. 6,183,836, for example.

Figure 9:
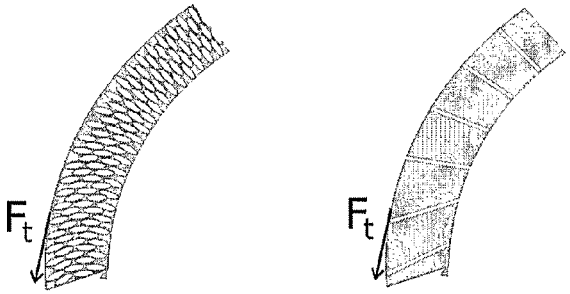
FIG. 9 shows a cross-section of a physical layer that consists of an anisotropic cell structure (left), and a physical layer that consists of an anisotropic honeycomb structure (right) behaving anisotropically under influence of a tangential force component $F_t$.

A physical layer is thereby provided consisting of an anisotropic structure that has a low resistance against deformation induced by tangential impacts on the helmet, which results in the structural behaviour under influence of a tangential force $F_t$, as illustrated on FIG. 9 for both an anisotropic foam structure (left) and an anisotropic honeycomb structure (right).

Figure 10:
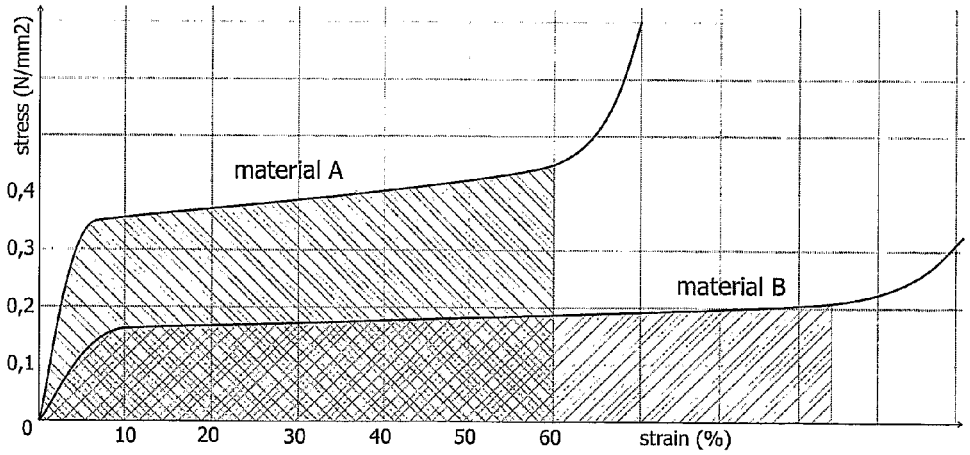

As a result of the low resistance against tangential deformation, the stress plateau of an anisotropic material (material B on FIG. 10) is much lower than the stress plateau of an isotropic material (material A on FIG. 10), in the case where a tangential force is applied to the material and in the appropriate directions for the "easy" direction of the anisotropic material. Consequently, the level of the force that is transferred to the head within the helmet will be lower, which will result in lower rotational accelerations. The energy that is dissipated during this deformation (hatched area under curve B on FIG. 10) is nevertheless comparable to the energy that is dissipated by an isotropic material (hatched area under curve A on FIG. 10), due to the fact that these anisotropic structures allow a high degree of deformation in the tangential direction. The construction of the functional unit (4) may vary in different ways, e.g. air, foam, honeycomb patterns, rubber. The following is a non-exhaustive list of anisotropic materials or materials that can be produced with anisotropic material properties suitable for use in the helmet, e.g. as cellular material such as foams or honeycombs:

- polyethersulfone (PES)
- polyurethane (PU)
- polyvinylchloride (PVC)
- low density polyethylene (LDPE) and high density polyethylene (HDPE)
- carbon foams
- metallic foams (aluminum and titanium are most cited)
- foams with hollow micro spheres (anisotropic material properties arise by the position of the hollow spheres with respect to each other)
- foams reinforced with short fibres and/or nanoclays or nanotubes (anisotropic material properties arise by the positioning of reinforcing elements)
- balsa wood
- honeycomb structures
- 3D knitted or woven honeycomb structures.

Furthermore, as will be explained further, anisotropic materials such as polyethersulfone (PES) show the same behaviour as an isotropic material, in case a normal force is applied to the material. Consequently, a physical layer consisting of an anisotropic structure can also take the role of functional unit (3). The functional unit (4) may therefore be combined with other units into one physical layer, e.g. combining unit (3) and (4) into one layer that absorbs energy arising from both normal (linear) and tangential (rotational) impact.

As a proof of concept, an anisotropic material (polyethersulfone (PES)) was subjected to mechanical tests, and compared to isotropic materials that are most commonly used for standard helmets (such as polystyrene (PS) and isotropic polyurethane ($PU_I$)).

Figure 11:
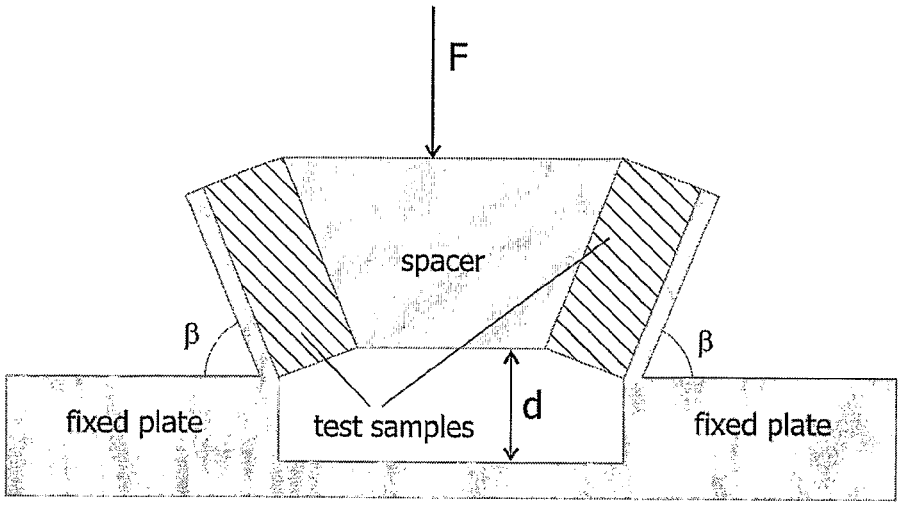
FIG. 11 illustrates the measurement setup where 2 test sample blocks (separated by a spacer) are subjected to an external force F, which is acting on the test samples at an angle β. Force F and displacement d are captured as a function of time.
Figure 12:
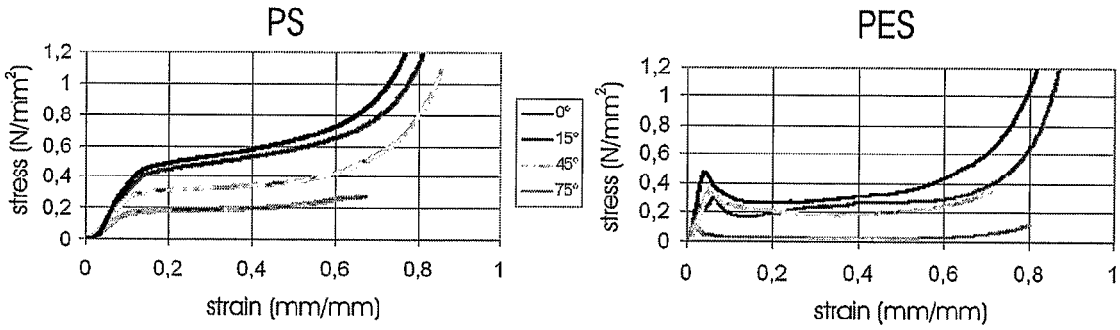
FIG. 12 compares material behaviour (stress as a function of strain) of PS (polystyrene, left) and PES (polyethersulfone, right) for different test angles β.

At a first stage, material behaviour was studied under different compression angles β (see FIG. 11). These compression tests were carried out using a computer-controlled Instron 4467 mechanical test machine, which has a speed range of 0.001-500 mm/min. During displacement-controlled compression (at a loading speed of 6 mm/min) both displacement (d) and force (F) were recorded (for which a 5 kN load cell was used). From these recordings the stress-strain curve can be plotted: strain is equal to displacement divided by the thickness of specimens; stress is equal to force divided by the area of specimens. The thickness and the area are measured by a vernier caliper before testing. Furthermore, a shear testing kit consisting of different spacers and fixed plates (see FIG. 11) was conceived to allow the following testing angles β: 0°, 15°, 45°, 75° and 90°. The specimens were attached to the shear kit by using cyanoacrylate glue (Loctite 406 nr. 40637) on both sides of the specimens, in order to avoid slippage of the specimens. When comparing PES to PS, for example, results show that PES has a much lower resistance to shear (β=75°), while the resistance to pure compression (β=0°) is of the same magnitude, as illustrated on FIG. 12. When comparing the energy absorption of the two materials, a comparable amount of energy is absorbed by PES as by PS.

Figure 13:
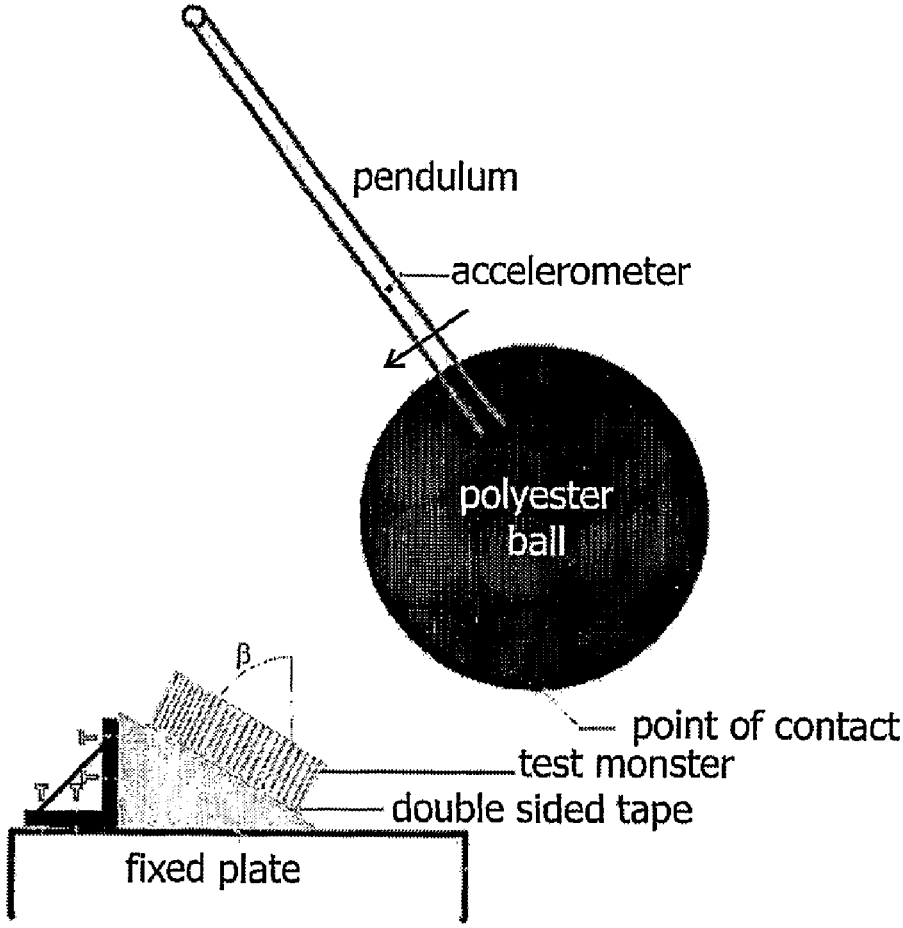
FIG. 13 illustrates the measurement setup where a test sample block is subjected to an external force F which is exerted by a ball on a pendulum, and which is acting on the test sample at an angle β; and, FIG. 14 illustrates how the orientation of the anisotropy can be varied, and how layers with a different orientation and/or degree of anisotropy can be combined.

At a second stage, material behaviour was studied in a more realistic setting; FIG. 13 shows a schematic overview of this setting. A polyester ball (weight 7 kg, radius 11 cm) is attached to a pendulum (total length 1.85 m). The test monsters were attached to the fixed plate by using double-sided tape (brand Tesa, width 50 mm, carpet fixation, product code 110002). Two uniaxial accelerometers (1 and 2 in table 1) are used to measure the linear acceleration in the direction of the arrow (see FIG. 13). From these accelerations, the rotational acceleration of the pendulum is calculated. Several anisotropic materials (such as polyethersulfone (PES) and anisotropic polyurethane ($PU_A$)) were compared to isotropic materials that are used for standard helmets, such as polystyrene (PS). 20 tests were performed for each material. Tests were performed at an angle β=70°. Table 1 illustrates that anisotropic materials successfully reduce the rotational accelerations, which are significantly lower for PES when compared to PS (about 40% lower). Differences in calculated values for the two accelerometers (1 and 2 in table 1) are due to calibration factors.

TABLE 1

| Material | $PU_A$ | | PES | | PS (reference) | |
|---|---|---|---|---|---|---|
| Accelerometer | 1 | 2 | 1 | 2 | 1 | 2 |
| Mean. rotational acceleration (rad/s$^2$) | 356.4 | 364.0 | 297.2 | 310.4 | 516.2 | 455.8 |
| St. Dev rotational acceleration (rad/s$^2$) | 17.5 | 17.6 | 30.7 | 19.9 | 118.6 | 80.2 |
| Rotational acceleration (% less compared to reference (PS)) | 31.0 | 29.5 | 42.4 | 39.9 | — | — |
| Measured absorbed energy Joules (determined from video recording of the experiment) | 66 | | 62 | | 64 | |
| Input energy Joules | 69.1 | | 69.1 | | 69.1 | |
| % age absorption | 95.7 | | 89.8 | | 92.5 | |

Particularly remarkable is that the advantageous reduction in acceleration of the head (or alternatively deceleration of the head if the head is moving and strikes an object) obtained with the anisotropic foams is obtained without a significant drop in energy absorption. This has significant advantages. If the energy that can be absorbed were to be reduced then the residual energy left over after impact could be transferred directly to the head, possibly causing harm, or could shear off the top outer layers of the helmet.

Figure 14:
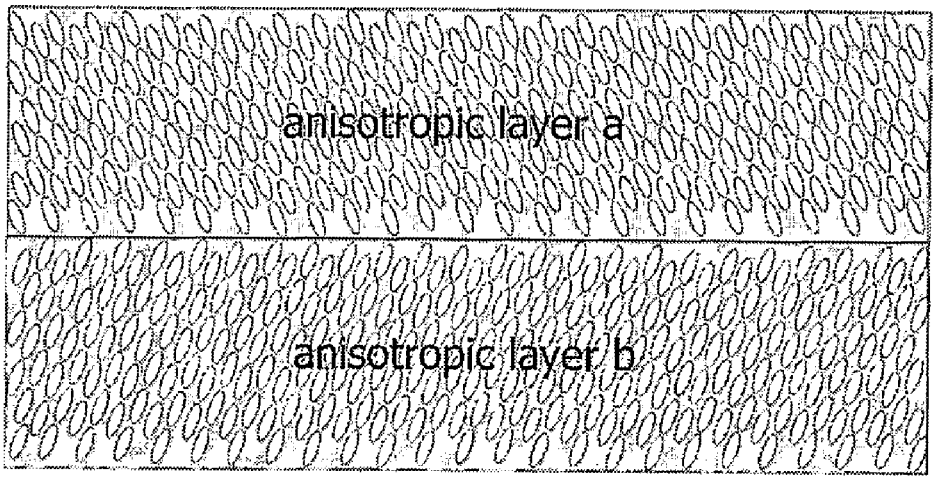

The degree and the orientation of the anisotropy can be adjusted (see anisotropic layer (a) on FIG. 14) to optimize the proportion of the protection against normal impact forces with respect to the protection against tangential impact forces, in order to protect against specific types of impact, if necessary. Also, a combination can be made of several physical layers with different degrees of and orientations of anisotropy, as illustrated in FIG. 14. In this case both physical layer (a) and physical layer (b) contribute to the protection against normal impact forces (functional unit 3) and against tangential impact forces of different directions (functional unit 4).

In case of the exemplary protective helmet described above, the physical layer (e) corresponding the fifth functional unit (5) is intended for contact with the head of the wearer, and ensures a comfortable fit. In comparison to the inner layer of helmets that are currently available on the market, this layer ensures not only comfort, but also a custom-made fit, which is important to decrease the risk that the helmet would separate from the head during impact. This custom-made fit is obtained by incorporating the anthropometrical characteristics of the head in the design of the layer, e.g. by copying the dimensions of the head exactly onto the layer, or by using separate modules that can be adjusted with respect to each other.

REFERENCES

[1] Gernarelli T, Thibault L, Ommaya A, Pathophysiologic responses to rotational and translational accelerations of the head, 16$^{th}$ Stapp Car Crash Conference 1972, Detroit (Mich.)

[2] Ommaya A K, Gennarelli T A, Cerebral concussion and traumatic unconsciousness; correlation of experimental and clinical observations of blunt head injuries, Brain 1974, 97(4), 633-654

[3] Ommaya A K, Hirsch A, Martinez J, The role of "whiplash" in cerebral concussion, 10$^{th}$ Stapp Car Crash Conference 1966, Holloman Air Force Base (N. Mex.).

[4] Gennarelli T A, Thibault L E, Adams J H, Graham D I, Thompson C J, Marcincin R P, Diffuse axonal injury and traumatic coma in the primate, Ann Neurol 1982, 12, 564-574

[5] Gennarelli T A, Thibault L E, Tomei G, Wiser R, Graham D, Adams J, Directional dependence of axonal brain injury due to centroidal and non-centroidal acceleration, 31st Stapp Car Crash Conference 1987, New Orleans (La.)

[6] Hirsch A E, Ominaya A K, Protection from brain injury: the relative significance of translational and rotational motions of the head after impact, 14th Stapp Car Crash Conference 1970, Ann Arbor (Mich.)

[7] Depreitere B, A rational approach to pedal cyclist head protection, Acta Biomedica Lovaniensia, Leuven University Press 2004, Leuven, ISBN 9058673759

[8] Collier R, Materiaalonderzoek voor valhelmen, Masters Thesis Group-T, Leuven 2001

[9] Ashby M F, Gibson L J, Cellular Solids, 1st edition, Pergamnon Press, Oxford, 1988, p 130

The invention claimed is:

1. A protective helmet for absorbing impact energy comprising:

an outer layer;

an inner layer for contact with a head of a wearer; and an intermediate layer comprising an anisotropic foam material comprising cells having cell walls, the anisotropic foam material having such structural properties that a difference in plateau-stress between two orthogonal directions exceeds 15% and being arranged in a manner that a direction of easy deformation lies in the direction of tangential forces on the helmet, and a further layer which is arranged adjacent to the intermediate layer and is arranged to absorb part of the impact energy by plastic or elastic deformation.

2. A helmet according to claim 1, wherein the anisotropic foam material is a closed cell foam.

3. A helmet according to claim 1, wherein deformation properties of the anisotropic material depend on orientation of cells forming the anisotropic material.

4. A helmet according to claim 1, wherein deformation properties of the anisotropic material depend on wall thickness of cells forming the anisotropic material.

5. A helmet according to claim 1, comprising two layers of anisotropic material, the two layers having different anisotropic properties.

6. A helmet according to claim 5, wherein a first of said two layers of anisotropic material has a direction of easiest deformation which is different from a direction of easiest deformation of the second of the two anisotropic layers.

7. A helmet according to claim 1, wherein the intermediate layer is further arranged to absorb energy in a direction normal to the helmet.

8. A helmet according to claim 1, wherein the outer layer comprises a material which is arranged, in use, to distribute forces acting on the helmet over a larger surface.

9. A helmet according to claim 8, wherein the outer layer comprises a polycarbonate or fibre-reinforced plastics layer.

10. A helmet according to claim 1, wherein there are first and second further layers, the first further layer being formed of a material which is softer than a material used for the second further layer.

11. A helmet according to claim 1, wherein the first further layer comprises polyurethane foam or polystyrene.

12. A helmet according to claim 10, wherein the first further layer comprises polyurethane foam or polystyrene.

13. A helmet according to claim 2, wherein deformation properties of the anisotropic material depend on wall thickness of cells forming the anisotropic material.

14. A helmet according to claim 2, comprising two layers of anisotropic material, the two layers having different anisotropic properties.

15. A helmet according to claim 14, wherein a first of the two layers of anisotropic material has a direction of easiest deformation which is different from a direction of easiest deformation of the second of the two layers of anisotropic layers.

16. A helmet according to claim 2, wherein the intermediate layer is further arranged to absorb energy in a direction normal to the helmet.

17. A helmet according to claim 2, wherein the outer layer comprises a material which is arranged, in use, to distribute forces acting on the helmet over a larger surface.

18. A helmet according to claim 2, comprising a first further layer which is arranged, in use, to absorb part of the impact energy.

19. A helmet according to claim 18, wherein there are first and second further layers, the first further layer being formed of a material which is softer than a material used for the second further layer.

20. A helmet according to claim 1, wherein the anisotropic foam material has a degree of anisotropy defined by a ratio of the plateau-stress of a sample of the anisotropic foam material oriented at 0° testing to the plateau-stress of the sample of the anisotropic foam material oriented at 75° testing exceeding the value of 5.

* * * * *